US006643582B2

(12) United States Patent
Adachi et al.

(10) Patent No.: US 6,643,582 B2
(45) Date of Patent: Nov. 4, 2003

(54) WORK MANAGEMENT METHOD, MANAGEMENT SYSTEM AND MANAGEMENT APPARATUS SUITED TO WORK SITES

(75) Inventors: Hiroyuki Adachi, Tsuchiurashi (JP); Toichi Hirata, Ushikushi (JP); Genroku Sugiyama, Ibaraki (JP); Hiroshi Watanabe, Ushikushi (JP); Koichi Shibata, Tsuchiurashi (JP); Hideki Komatsu, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/980,101

(22) PCT Filed: Mar. 30, 2001

(86) PCT No.: PCT/JP01/02813

§ 371 (c)(1),
(2), (4) Date: Nov. 29, 2001

(87) PCT Pub. No.: WO01/73223

PCT Pub. Date: Oct. 4, 2001

(65) Prior Publication Data

US 2002/0165656 A1 Nov. 7, 2002

(30) Foreign Application Priority Data

Mar. 31, 2000 (JP) ..... 2000-099163

(51) Int. Cl.[7] ..... G08G 1/123

(52) U.S. Cl. ..... 701/207; 701/50; 701/208; 340/988; 56/10.2 A

(58) Field of Search ..... 701/207, 208, 701/213, 214, 200, 50; 340/988; 73/178 R; 56/10.2 A, 10.2 B, 10.2 D

(56) References Cited

U.S. PATENT DOCUMENTS 5,684,476 A * 11/1997 Anderson ..... 340/988
5,955,973 A * 9/1999 Anderson ..... 340/988

FOREIGN PATENT DOCUMENTS

| | | |
|---|---|---|
| EP | 0 989 525 A2 | 3/2000 |
| JP | B2 2523005 | 5/1996 |
| JP | A 8-221694 | 8/1996 |
| JP | A 9-256635 | 9/1997 |
| JP | A 10-317415 | 12/1998 |

* cited by examiner

*Primary Examiner*—Thomas G. Black
*Assistant Examiner*—Arthur D. Donnelly
(74) *Attorney, Agent, or Firm*—Oliff & Berridge, PLC

(57) ABSTRACT

The position of a working machine is detected, a position signal representing the detected position is transmitted, the position signal is received, management information relating to the working machine is calculated based on the received position signal, and the calculated management information is transmitted to the working machine. Example of management information is type of attachment depending on soil quality, and weather forecasts.

16 Claims, 13 Drawing Sheets

FIG.10A

SOIL QUALITY SYMBOL

| | SOIL QUALITY |
|---|---|
| A | GRAVEL |
| B | KANTO LOAM |
| C | BEDROCK |
| D | CLAY |
| | |

FIG.10B

| | LONGITUDE | | | | | |
|---|---|---|---|---|---|---|
| LATITUDE | A | A | A | A | B | B |
| | A | A | A | B | B | B |
| | A | A | B | B | C | C |
| | B | B | B | C | C | C |
| | B | B | B | C | C | C |

FIG.10C

| SOIL QUALITY | BUCKET CLAWS |
|---|---|
| A: GRAVEL | CLAWS A |
| B: KANTO LOAM | CLAWS B |
| C: BEDROCK | CLAWS C |

FIG.10D

| REGION | 1 | 2 | 3 | 4 | 5 | 6 | 7 | 8 | 9 | 10 |
|---|---|---|---|---|---|---|---|---|---|---|
| HOKKAIDO | ◎ | ◐ | ○ | ● | ○ | ● | ● | ◎ | ◎ | ◐ |
| TOHOKU | ◎ | ◎ | ● | ○ | ◐ | ◐ | ◐ | ● | ◎ | ◎ |
| KANTO | ◎ | ◐ | ○ | ● | ○ | ○ | ○ | ● | ◎ | ◎ |
| CHUBU | ◎ | ◎ | ● | ○ | ○ | ○ | ◐ | ◎ | ◎ | ◎ |
| | | | | ○ | ○ | ○ | ◎ | ● | ● | ○ |
| | | | | | | ○ | ● | ● | ◐ | ○ |

WORK MANAGEMENT METHOD, MANAGEMENT SYSTEM AND MANAGEMENT APPARATUS SUITED TO WORK SITES

TECHNICAL FIELD

The present invention relates to a work management method, a management system and management apparatus for calculating various types of management information based on current locations of work sites where working machines such as construction machines are actually operating, and transmitting this management information to a working machine.

BACKGROUND ART

For example, construction sites where construction machines such as hydraulic excavators or cranes (hereafter referred to as construction machines) are operating are spread over a wide range, and the type of work carried out at each work site varies depending on the circumstances inherent to each work site.

Because of this, an operator or a work site supervisor must perform complicated management of suitable construction machine conditions and construction processes for each site, and this task is complex

DISCLOSURE OF THE INVENTION

The object of the present invention is to provide a work management method, management systems and management apparatus that calculate various management information based on geographical factors of a work site at a working machine monitoring facility, and transmits the information to a working machine (1)A work management apparatus or system of the present invention comprises a management information calculation device that calculates management information relating to a working machine based on position of the working machine, that has been transmitted, and a transmitter that transmits the management information calculated by the management information calculation device to the working machine. With the present invention, the position of a working machine is detected, a position signal for the detected position is transmitted, the position signal for the working machine is received, management information relating to the working machine is calculated based on the received position signal, and the calculated management information is transmitted to the working machine.

According to the present invention described above, various types of management information are calculated based on the detected geographical factors of the site where the working machine is actually operating, and transmitted to the working machine. Accordingly, it is possible for the working machine to carry out work based on management information appropriate to the site of the working machine.

(2) A work management apparatus or system of the present invention comprises a soil quality calculator that calculates soil quality based on a transmitted position of the working machine, an attachment information calculator that calculates attachment information for the working machine from the soil quality calculated by the soil quality calculator, and a transmitter that transmits the attachment information calculated by the attachment information calculator to the working machine. With the present invention, the position of a working machine is detected, a position signal for the detected position is transmitted, the position signal for the constriction machine is received, soil quality is calculated based on the received position signal, attachment information for the working machine is calculated based on the calculated soil quality, and the calculated attachment information is transmitted to the working machine.

According to the present invention, soil quality is determined based on the detected geographical factors of the location where working machine is actually operating, and attachment information is calculated according the this soil quality and transmitted to the working machine. Accordingly, an attachment that is appropriate for the operating location can be easily selected.

(3) A work management apparatus or system of the present invention further comprises a related facility calculation device that calculates related facility information for the vicinity of the site of the working machine based on the position of the working machine, that has been transmitted, and a transmitter that transmits the calculated related facility information to the working machine. With the present invention, the position of a working machine is detected, a position signal for the detected position is transmitted, the position signal for the working machine is received, related facility information for the vicinity of the site of the working machine is calculated based on the received position signal, and the calculated related facility information is transmitted to the working machine.

According to the present invention, related facility information for the vicinity of a site where working machine is operating is calculated based on detected geographical factors of that site, and this information is transmitted. Accordingly, it is possible for the operator of the working machine to easily access the related facility.

(4) A work management apparatus or system of the present invention comprises a weather forecast calculation device that calculates a weather forecast of the site of the working machine based on position of the working machine, that has been transmitted, and an amendment unit that amends a work schedule table for the working machine created in advance, based on the calculated weather forecast. With the present invention, position of the working machine is detected, a position signal for the working machine is received, a weather forecast of the site of the working machine is determined based on the received position signal, and a work schedule table for the working machine created in advance is amended, based on the determined weather forecast.

According to the present invention, since a weather forecast is determined based on the detected geographical factors of the site where the working machine is operating, and a work schedule table is amended, it is possible to quickly update the work schedule table in accordance with the weather.

BRIEF DESCRIPTION OF THE DRAWINGS

FIG. 10A is a drawing showing a correspondence table for soil quality and soil quality symbols.

FIG. 10B is a drawing showing a correspondence table for regions divided in a mesh format and soil quality.

FIG. 10C is a table showing a relationship between soil quality and bucket claws.

FIG. 10D is a drawing showing one example of a weather forecast table.

BEST MODE FOR CARRYING OUT THE INVENTION

Referring to FIG. 1–FIG. 14, a work management method based on work sites of hydraulic excavators to which the present invention is applied will now be described.

Figure 1:
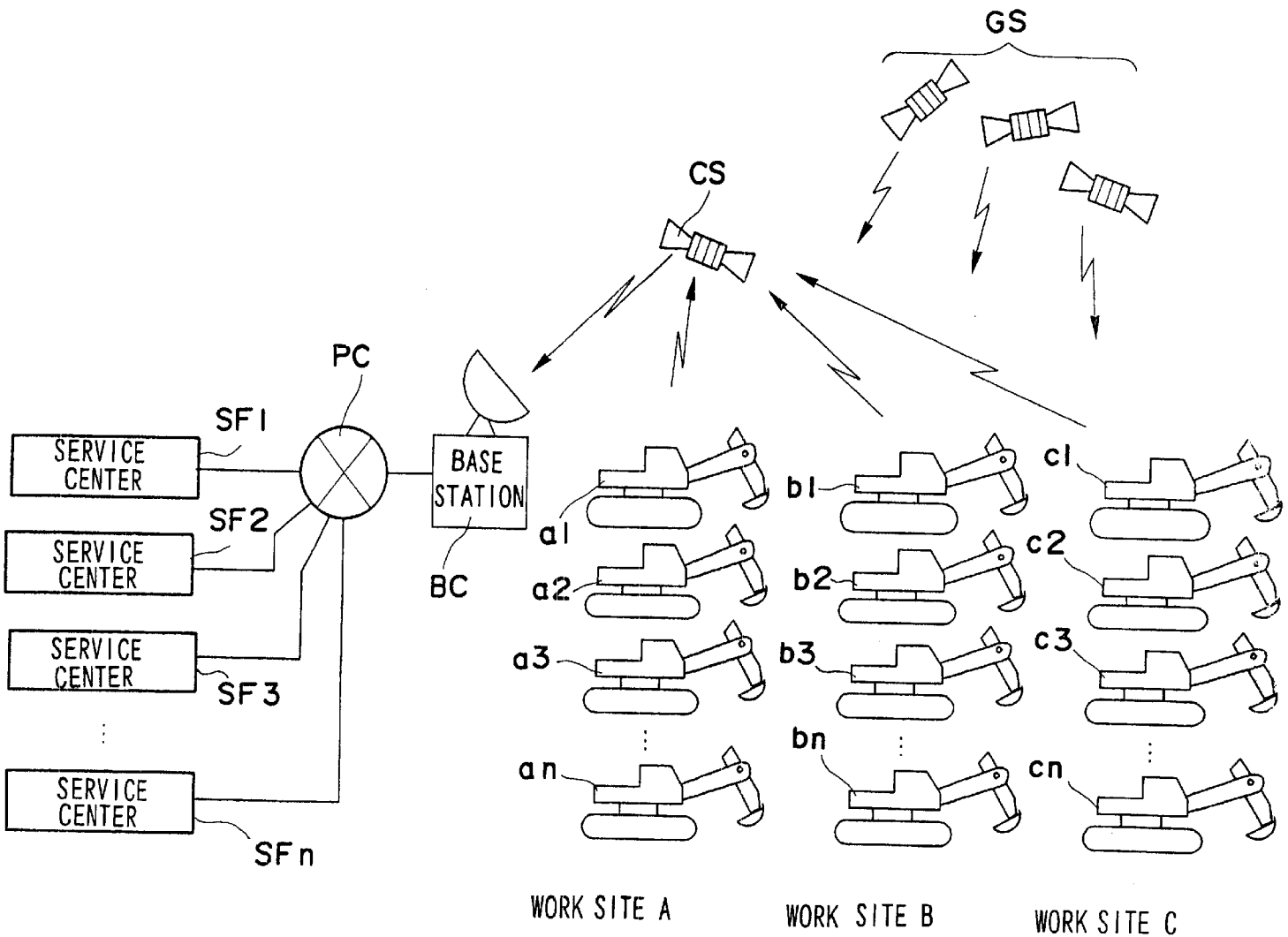
FIG. 1 is a drawing showing operating conditions of a hydraulic excavator to which a work management method based on a work site, of the present invention, is applied.

FIG. 1 is a drawing for describing operating conditions of a hydraulic excavator to which a work management method based on work sites, of the present invention, is applied. Specifically, a plurality of hydraulic excavators are respectively operating at a plurality of work sites A, B and C. Hydraulic excavators a1—an are operating at site A, hydraulic excavators b1—bn are operating at site B, and hydraulic excavators c1—cn are operating at site C. The sites A, B and C are not the same work site and are separated geographically. In this embodiment, each hydraulic excavator calculates its own current position based on signals from a GPS satellite, and transmits the current position to a service center SF via a communications satellite CS and a base station BC. At the service center SF, various items of management information are calculated according to geographical factors of the sites where the respective hydraulic excavators are operating, and the management information is transmitted from the service center SF to each hydraulic excavator via the communications satellite CS.

Figure 2:
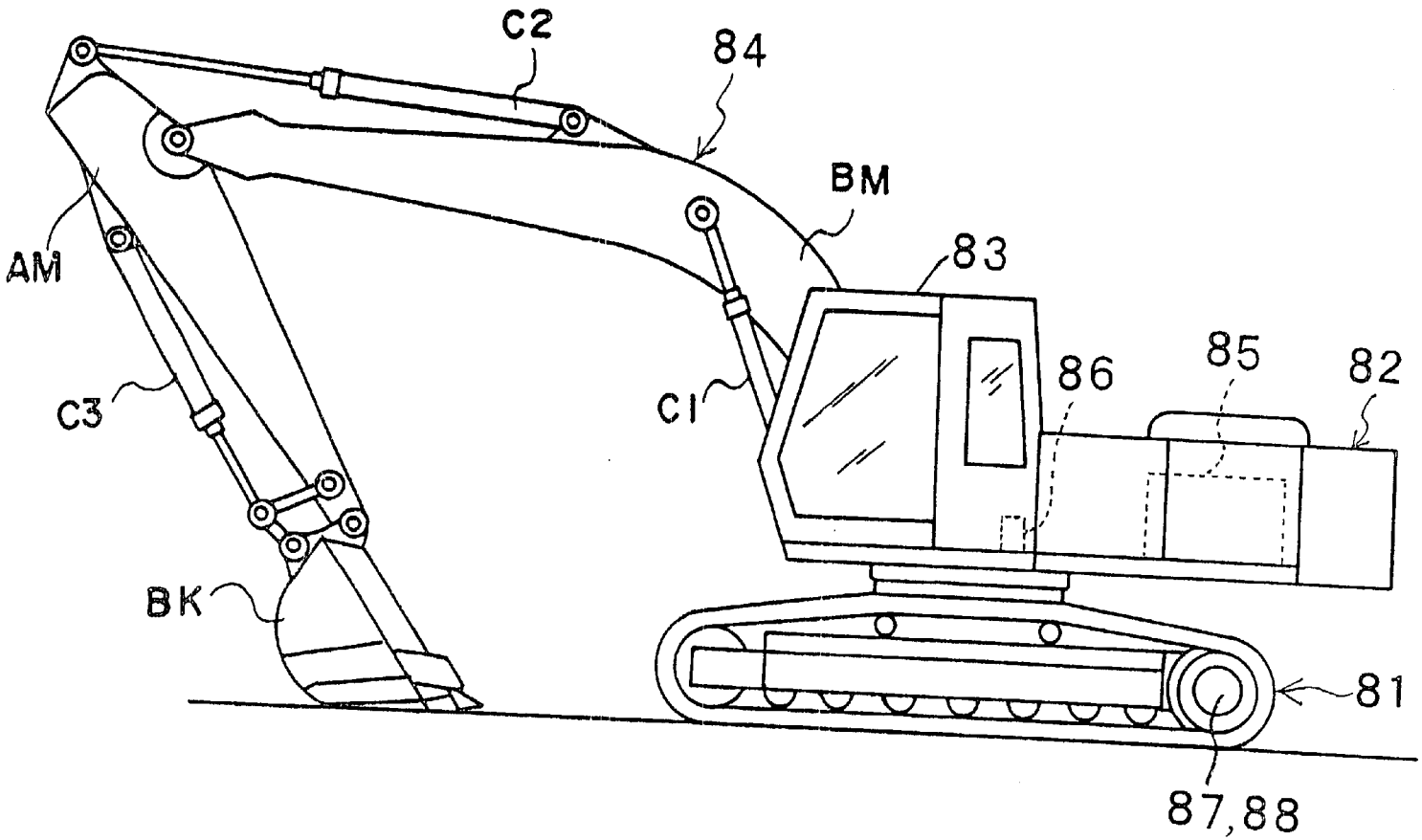
FIG. 2 is a drawing showing one example of a hydraulic excavator.

A hydraulic excavator is constructed as shown in FIG. 2. The hydraulic excavator has a travelling body 81, and a turning body 82 connected to an upper part of the travelling body 81 so as to be capable of turning An operator's cabin 83, a working unit 84, an engine 85 and a turning motor 86 are provided in the turning body 82. The working unit 84 comprises a boom BM attached to the body of the turntable section 82 so as to be capable of rotation, an arm AM rotatably linked to the boom BM, and an attachment, for example a bucket BK, rotatably linked to the arm AM. The boom BM is raised and lowered by a boom cylinder C1, the arm AM is made to perform crowd and dump operations using an arm cylinder C2, and the bucket BK is made to perform crowd and dump operations by the bucket cylinder C3. Left and right hydraulic travel motors 87 and 88 are provided in the travelling body 81.

Figure 3:
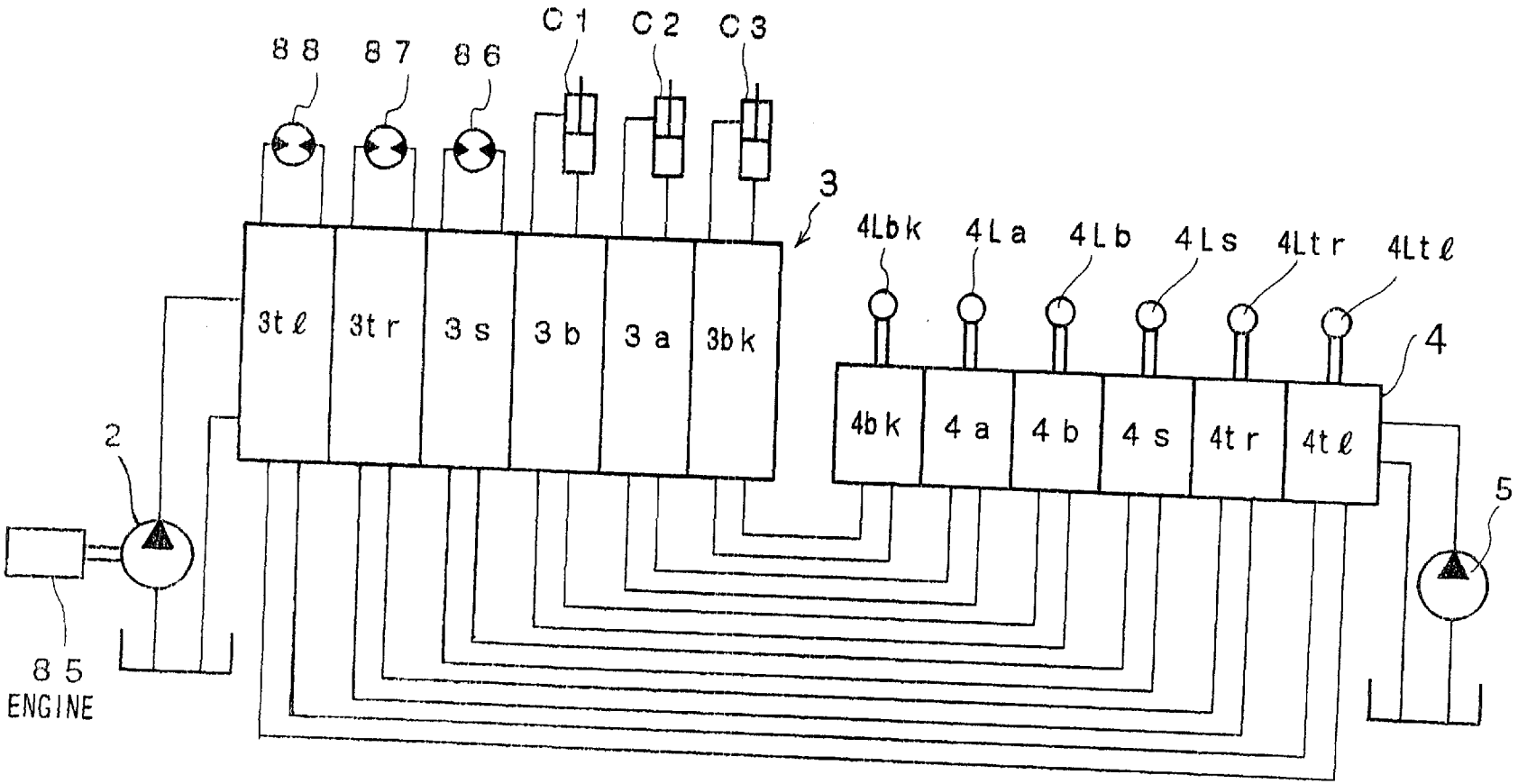
FIG. 3 is a drawing showing an example of the hydraulic circuits of a hydraulic excavator.

FIG. 3 schematically shows the hydraulic circuits of the hydraulic excavator. The engine 85 drives the hydraulic pump 2. Hydraulic fluid expelled from this hydraulic pump 2 is controlled in various directions by a plurality of control valves 3*s*, 3*tr*, 3*tl*, 3*b*, 3*a* and 3*bk*, and drives the above described turning hydraulic motor 86, left and right travel hydraulic motors 87 and 88, and the hydraulic cylinders C1, C2 and C3. The plurality of control valves 3*s*, 3*tr*, 3*tl*, 3*b*, 3*a* and 3*bk* are switched by pilot pressure respectively supplied from a plurality of respectively corresponding pilot valves 4*s*, 4*tr*, 4*tl*, 4*b* and 4*bk*. Pilot valves 4*s*, 4*tr*, 4*tl*, 4*b*, 4*a* and 4*bk* receive pilot hydraulic fluid at a specified pressure supplied from a pilot valve hydraulic pump 5, and output pilot pressure according to an amount of actuation of actuation levers 4Ls, 4Ltr, 4Ltl, 4Lb, 4La and 4Lbl. The plurality of control valves 3*s*, 3*tr*, 3*tl*, 3*b*, 3*a* and 3*bk* are integrated in a single valve block. The plurality of pilot valves 4*s*, 4*tr*, 4*tl*, 4*b*, 4*a* and 4*bk* are also integrated in a single valve block.

Figure 4:
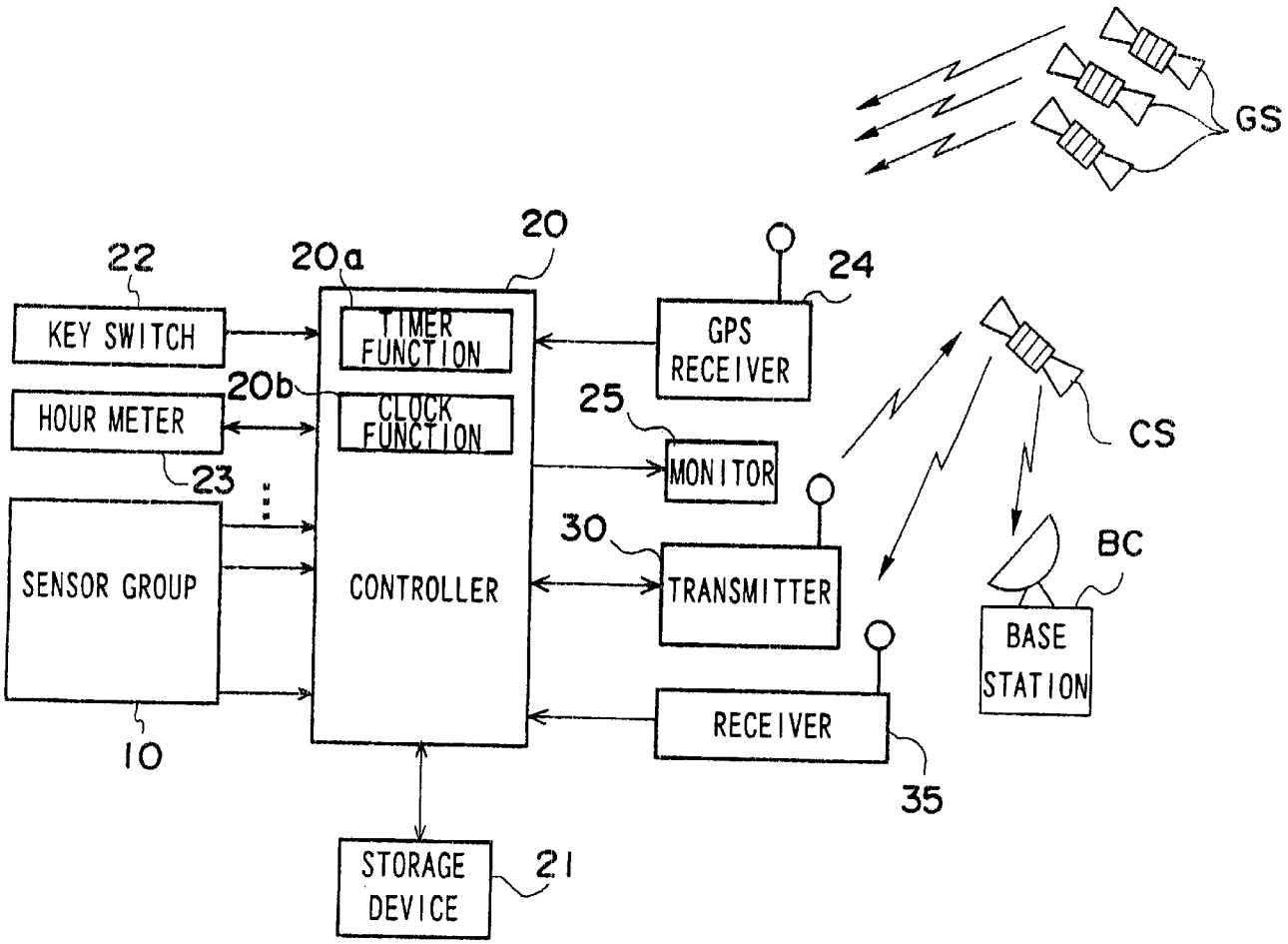
FIG. 4 is a block diagram showing one example of the structure of a controller for a hydraulic excavator.
Figure 7:
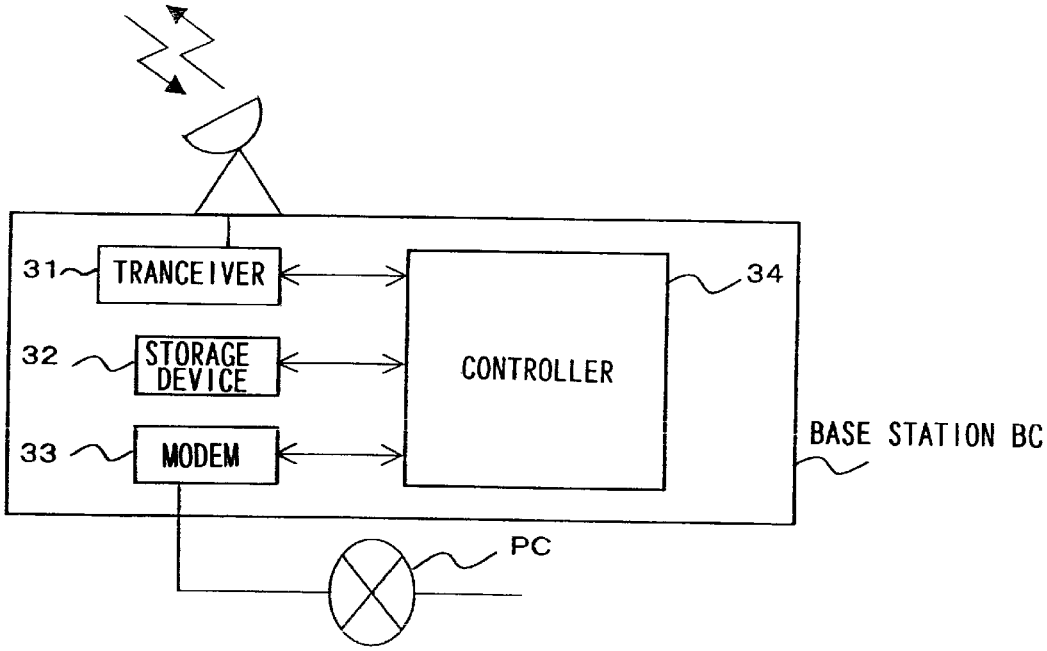
FIG. 7 is a block diagram showing one example of the hardware structure for information management in a base station.
Figure 9:
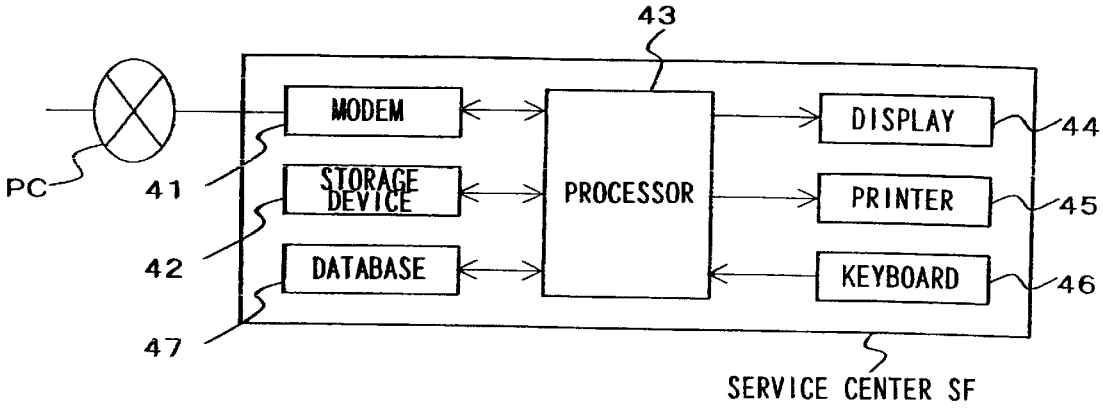
FIG. 9 is a block diagram showing one example of the hardware structure for information management in a service station.

FIG. 4 is a block diagram of a control system for detecting and transmitting current locations and states of each of the parts of the hydraulic excavator, and also receiving management information. A GPS receiver 24 for receiving GPS signals from the GPS satellite GS is mounted in the hydraulic excavator, and a controller 20 calculates the current location of the hydraulic excavator based on the GPS signals. A sensor group 10 having a plurality of sensors for detecting the state of the hydraulic pumps etc. is mounted in the hydraulic excavator, and state detection signals output from the sensor group 10 are read into the controller 20 at a specified timing. For example, the controller 20 calculates travel operation time, turning operation time and front (excavation)operation time based on signals from the sensor group 10. Current location information, or each of the calculated operation times, are temporarily stored in a storage device 21. Operational information is transmitted from a transmitter 30 at a specified timing, and passed to the base station BC through the satellite CS. On the other hand, current location information is transmitted from the transmitter 30 when a transmit switch 26 provided in the hydraulic excavator is turned on, and passed to the base station BC through the satellite CS. Operational information and current location information received at the base station 26 can also be received in the service center SF via a general public network, as shown in FIG. 7 and FIG. 9.

A receiver 35 is also connected to the controller 20. This receiver 35 receives signals for various management information transmitted from the base station BC through the communications satellite CS, and transmits these signals to the controller 20. A monitor 25 for displaying various information is provided in the driver's seat of the hydraulic excavator, and the controller 20 displays received management information as required.

Figure 5:
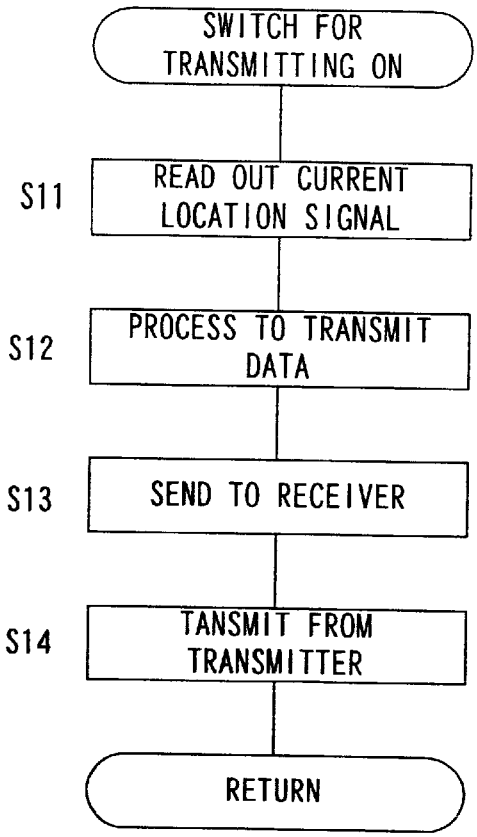
FIG. 5 is a flowchart showing an example of a current location transmission process.

FIG. 5 is a flowchart showing processing flow for transmitting a signal representing current location (current location signal) when the transmission switch 26 of the hydraulic excavator is operated. If the transmission switch 26 is turned on, the controller 20 starts the program shown in FIG. 5. In step 11, a current position signal to be transmitted is read out from the storage device 21. The read out current position signal is processed into specified transmission data in step S12, and sent to the transmitter 30 in step S13. Then, the transmitter 30 transits the current position of the hydraulic excavator to the base station BC via the communications satellite CS. Current location information is calculated when a key switch for starting the engine is turned on, or when the transmit switch 26 is turned on, and that timing is not important.

Figure 6:
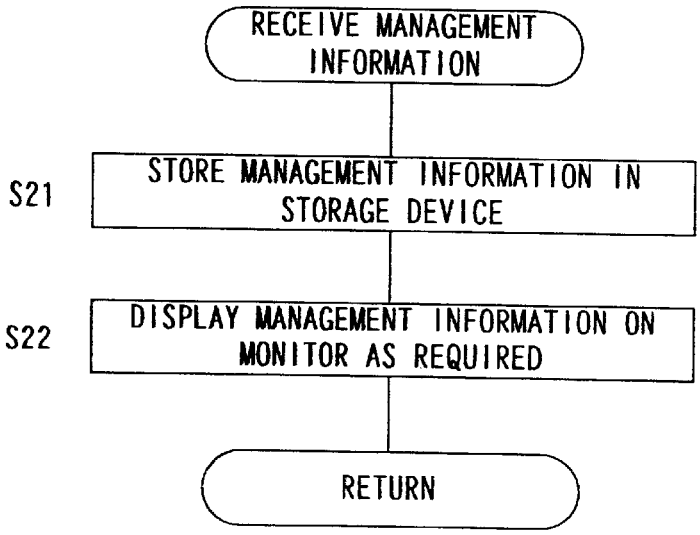
FIG. 6 is a flowchart showing an example of a management information display process.

FIG. 6 is a flowchart showing processing flow executed by the controller 20 of the hydraulic excavator when the receiver 35 has received management information. The controller 20 receives management information from the base station BC, and thereafter starts the program shown in FIG. 6. In step S21, received management information is temporarily stored in the storage device 21. Then in step S22, the management information is displayed on the drivers seat monitor 25 as required. The management information of this embodiment is a type of bucket claw, a work process schedule that has been updated according to a weather forecast, a telephone number of a gas station that is closest to the operation site, or a telephone number of a service center. However, the management information is not thus limited, and includes various management information relating to a hydraulic excavator.

FIG. 7 is a block diagram showing the structure for information management in a base station BC. The base station BC stores various received signals, and as required transmits the signals to the service center SF. For this reason, at the base station BC, provided are a transceiver 31 for receiving signals transmitted from the communications satellite CS and transmitting, for example, management information from the service center SF, a storage device 32 for storing signals received by the taransceiver 31 and storing management information from the service center SF, a modem 33 for transmission of data to be transmitted to the service station SF through a general public network PC and receipt of management information from the service center SF, and a controller 34 for controlling these various devices. It is also possible to access the base station BC from the service center SF, for example, via a general public network PC.

Figure 8A:
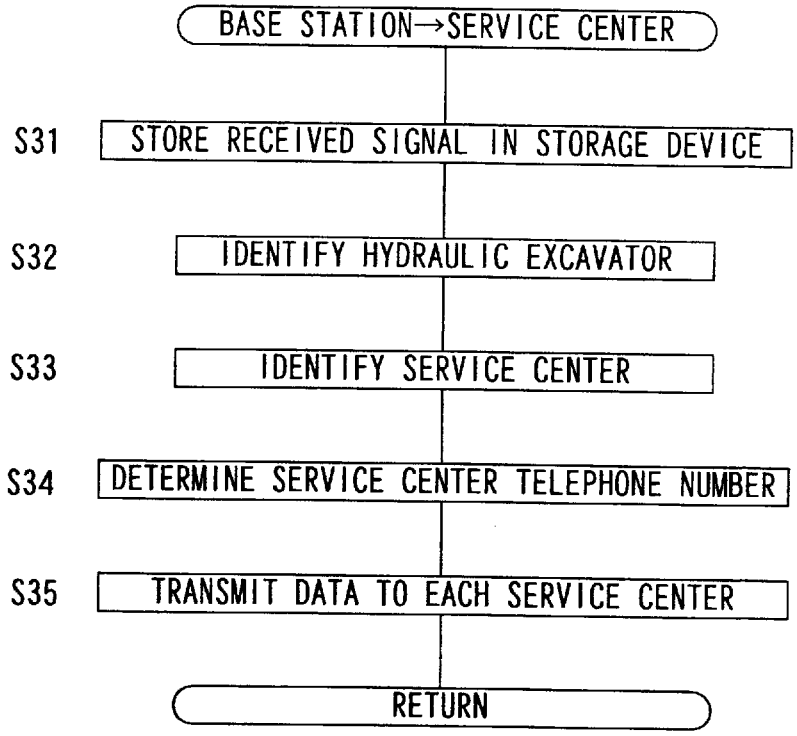
FIGS. 8A and 8B are flowcharts showing examples of processing flow in a base station.

FIG. 8A is a flowchart showing processing flow for receipt of current position signal etc. by the base station BC and transmission to the service center SF. The controller 34 of the base station BC receives signals from the communications satellite CS, and starts the program shown in FIG. 8A. In step S31, received signals are temporarily stored in the storage device 32. In step S32, a hydraulic excavator is identified from an identifier stored at the header of the received signal, and in step 33 a service center in charge is identified based on the identified hydraulic excavator. In step S34, a telephone number of the identified service center is read out from a database created in advance in the storage device 32. In step S35, a current location signal of the hydraulic excavator is transmitted together with the identifier to each service center SF through the modem 33.

Transmission of various information from the base station BC to each service center SF is preferably performed over a dedicated line or a LAN connection. For example, if the base station BC and the service center SF are facilities of the manufacturer of the hydraulic excavator, the various information can be sent and received using a so-called in-house LAN (intranet).

Figure 8B:
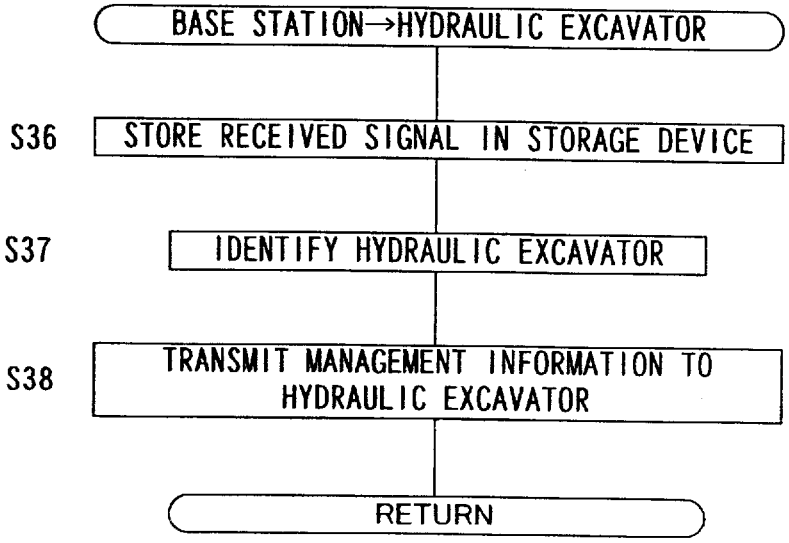

FIG. 8B is a flowchart showing processing flow for receipt of, for example, management information transmitted from the service center SF by the base station BC, and transmission to the hydraulic excavator. The controller 34 of the base station BC receives signals from the service center SF and starts the program shown in FIG. 8. In step S36, received signals are temporarily stored in the storage device 32. In step S37, a hydraulic excavator is identified from the identifier stored in the header of the received signal, and management information is sent to the identified hydraulic excavator.

FIG. 9 is a block diagram showing the structure for information management in the service station SF. At the service center SF, provided are a modem 41 for receiving signals sent from the base station BC through a general public network PC and transmitting calculated management information to the base station BC via a general public network PC, a storage device 42 for storing signals received by the modem 41 and storing management information to be transmitted, a processor 43 for executing various arithmetic operations, a display 44 and a printer 45 connected to the processor 43, and a keyboard 46. The processor 43 calculates various items of management information based on current location signals stored in the storage device 42.

A database 47 is also connected to the processor 43. Soil quality information for various places in Japan, and weather forecast information, are stored in the database 47. The weather forecast information is updated every day through a general public network PC (for example the Internet) and stored in the database 47.

FIG. 10A and FIG. 10B are drawings showing soil quality tables. FIG. 10B is a table showing correspondence between regions divided in advance in a mesh format and soil quality of those regions. Symbols A, B and C in FIG. 10B are gravel, kanto loam and base rock, as shown in FIG. 10C, and clay layers are represented by the symbol D. Divided regions can be of a specified extent, or of an extent depending on distribution of the soil quality, but the extent and shape of the regions are not actually important. FIG. 10D shows a weather forecast information table which contains weather forecasts in units of one month for every predetermined region. The weather forecasts can also be obtained daily from a weather intelligence provider via the Internet from the service center SF, and stored in the database 47. Alternatively, it is possible to get the weather information at the base station BC though a general public network PC, and store the information in the storage device 32 at the base station BC.

Figure 11:
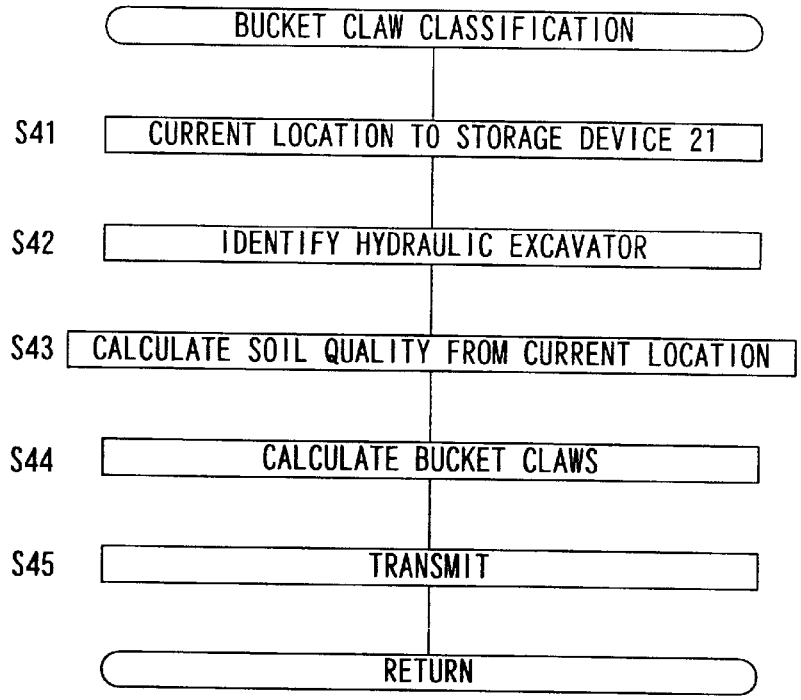
FIG. 11 is a flowchart showing an example of processing flow for selecting bucket claws according to soil quality.

FIG. 11 is a flowchart showing a procedure executed by the processor 43, based on a current location signal received by the service center SF. The processor 43 of the service center SF receives a current location signal and starts the program shown in FIG. 11. In step S41, the received current location signal is stored in the storage device 42 together with an identifier of the hydraulic excavator. In step S42, the type of hydraulic excavator, for example, is identified from the identifier of the received signal. In step S43, a soil quality table in the database 47 is searched using the current location signal, and the soil quality at the location where the hydraulic excavator is operating is calculated. The current location signal is a signal including latitude and longitude, and soil qualities are set in advance for each region, as shown in FIG. 10B. The processor 43 selects a region using the latitude and longitude, and reads out soil quality from the database 47. In step S44, bucket claw that is most suitable for the calculated soil quality is determined. Types of bucket claw suitable for soil quality are set in advance in the processor 43, as the database of FIG. 10C, for example. In step S45, transmission data is created in order to transmit the bucket claw information via the communications satellite CS, and transmitted to the relevant hydraulic excavator from the modem 41.

An identifier for a hydraulic excavator is provided in a header of data transmitted to the hydraulic excavator, and following that, data representing the type of bucket claw is provided. A signal representing the type of bucket claw is received by the hydraulic excavator in accordance with the processing shown in FIG. 6, and stored in the storage device 21 of the hydraulic excavator, at the same time as being displayed on the driver's seat monitor 25.

In the description given above, soil quality for the location where the hydraulic excavator is operating is read out and the most suitable bucket claw is selected, but it is also possible to select the shape of the bucket itself and the front attachment itself according to soil quality. In the event that the hydraulic excavator has an attachment that is an excavating bit, such as an earth drill, the bit most suitable to the soil quality can be selected. In this specification, the bucket claws, bucket shape and bit are all referred to as attachment information.

Figure 12:
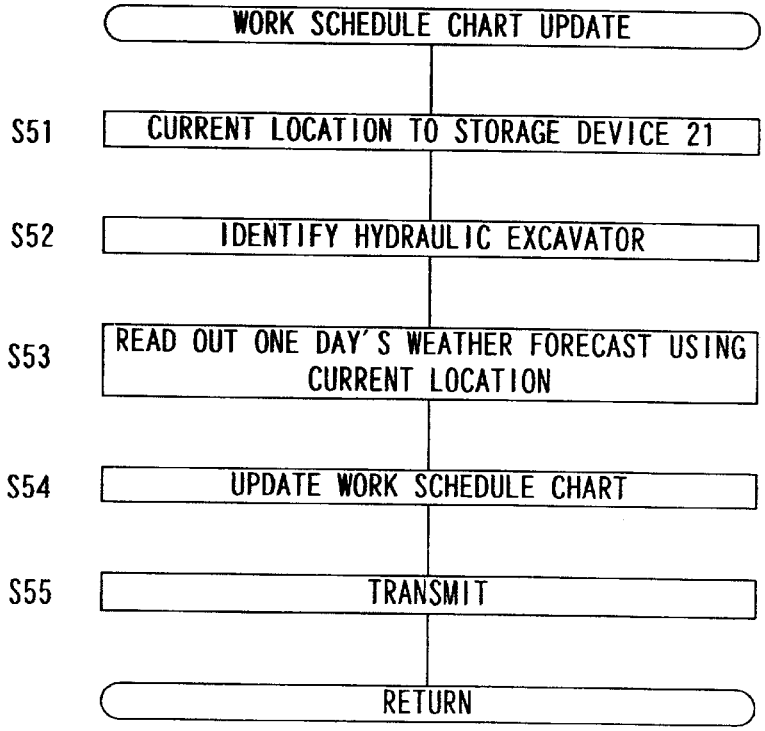
FIG. 12 is a flowchart showing an example of processing flow for updating a work schedule table using a weather forecast.

FIG. 12 is a flowchart showing another example of a procedure executed by the processor 43, based on a current location signal received by the service center SF. The processor 43 of the service center SF receives a current location signal and starts the program shown in FIG. 12. In step S51, the received current location signal is stored in the storage device 42 along with an identifier of the hydraulic excavator. In step S52, the hydraulic excavator is identified from the identifier of the received signal. In step S53, an area of a weather forecast is selected using the latitude and longitude of the current location and the weather forecast table in the database 47 is searched, and one month's weather forecasts for the location where the hydraulic excavator is operating are extracted. In step S54, a work schedule table is updated based on these weather forecasts. In step S55, transmission data is created for transmitting the updated work schedule table through the communications satellite CS, and transmitted to the relevant hydraulic excavator from the modem 41.

The work schedule table is received by the hydraulic excavator in accordance with the processing shown in FIG. 6, and stored in the storage device 21 at the same time as being displayed on the monitor 25.

Figure 13:
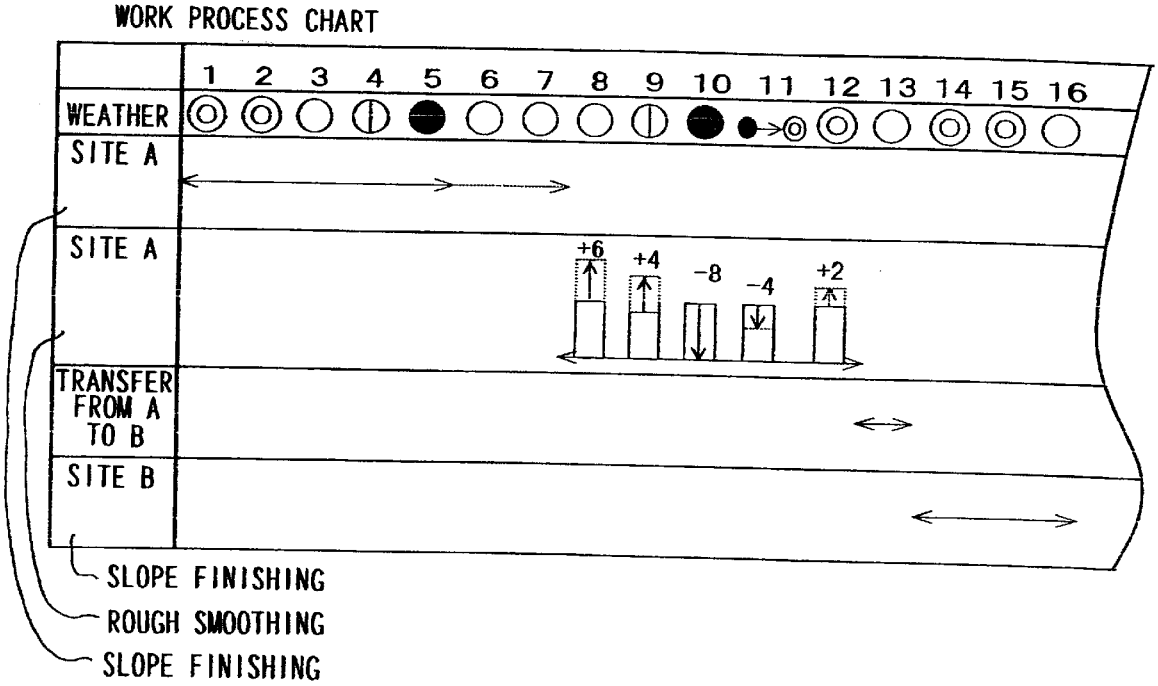
FIG. 13 is a drawing showing one example of a work schedule table.

FIG. 13 is a drawing for describing amendment of the work schedule table executed in step S54. In FIG. 13, March $1^{st}$-March $5^{th}$ is for slope finishing of site A, and March $6^{th}$ and March $7^{th}$ are spare days. March $8^{th}$-March $12^{th}$ is for rough smoothing at site A, March $13^{th}$ is for transferring to site B. and March 14–16 is for slope finishing at site B.

A description will now be given of work schedule chart update processing executed by the processor 43 of the service center SF that received the current location signal from the hydraulic excavator. The current date is March $1^{st}$, and weather forecasts for March $1^{st}$-March $16^{th}$ are shown in the upper row. For the period March $1^{st}$-March $7^{th}$ it can be anticipated that work will be suspended n March $5^{th}$ due to rain, but since both March $6^{th}$ and March $7^{th}$ are spare days there is no need to alter the work schedule. However, with respect to the rough smoothing work scheduled for the period March $8^{th}$-March $12^{th}$, there are no spare days allocated. Because March the $10^{th}$ is expected to be rainy all day and March $11^{th}$ is forecast to be rainy in the morning and cloudy in the afternoon, it can be anticipated that the work schedule will be delayed by one and a half days. It is necessary to guarantee that the amount of work for in a day and a half, that is, the amount of work for 12 hours, will be done during March $8^{th}$ to March $12^{th}$. In the example shown in FIG. 13, the work schedule chart is modified so as to carry out additional work for 6 hours on March $8^{th}$, 4 hours on March $9^{th}$ and 2 hours on March $12^{th}$, and regain the delay in the work schedule caused by rain.

By carrying out work schedule chart updates every day in this way, and transmitting a work schedule for the next day to the hydraulic excavator the day before, the operator of the hydraulic excavator or a site manager does not need to update the work schedule chart depending on the weather at all, and can start straight away with more complicated clerical work. The work schedule chart prior to update in FIG. 13 has been created in advance by a manager. The work of updating the work schedule chart of FIG. 13 can also be performed by various processes. By predicting free time for a hydraulic excavator based on this work schedule chart, other tasks such as servicing (maintenance) can be scheduled.

Figure 14:
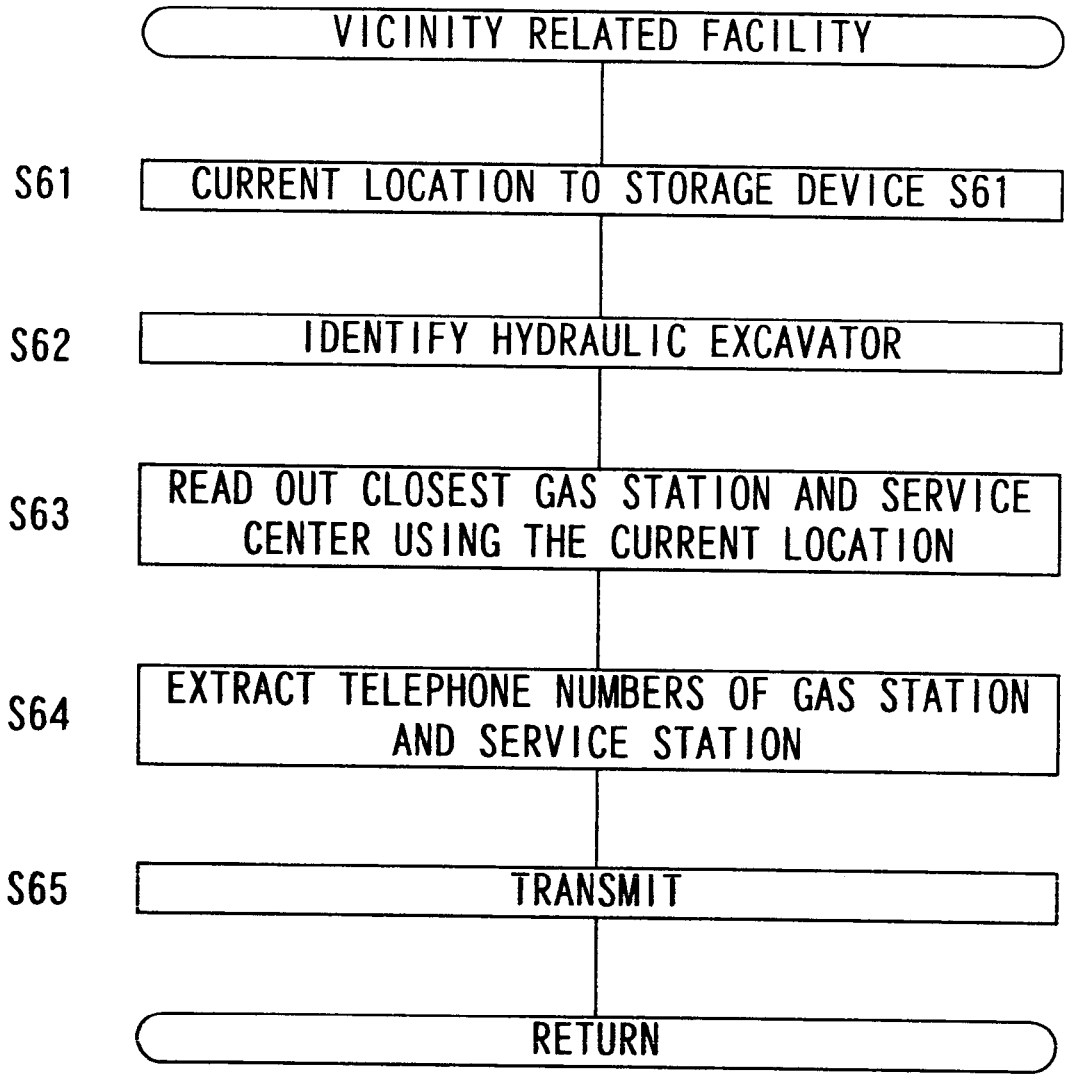
FIG. 14 is a flowchart showing an example of processing flow for extracting a telephone number for a related facility.

FIG. 14 is a flowchart showing another example of a procedure executed by the processor 43, based on a current location signal received by the service center SF. The processor 43 of the service center SF receives a current location signal and starts the program shown in FIG. 14. In step S61, the received current location signal is stored in the storage device 42 along with an identifier of the hydraulic excavator. In step S62, a hydraulic excavator is identified from an identifier of the received signal. In step S63, a gas station table and a service center table of the database 47 are searched using the current location signal.

The gas station table holds correspondence between the names, locations and telephone numbers of all the gas stations in the country. The service station table holds correspondence between the names, locations and telephone numbers of all the service centers in the country. Locations of the gas stations and service centers are specified by latitude and longitude, and the position of the hydraulic excavators are also specified by latitude and longitude. The processor 43 can then easily search for a gas station and a service center closest to the location of a hydraulic excavator.

In step S63, a gas station and service center closest to the location where a hydraulic excavator is operating are searched for, and their telephone numbers are extracted. In step S64, transmission data is created for transmitting the calculated telephone numbers of the gas station and service center SF through the communications satellite CS, and transmitted from the modem 41.

The telephone numbers of the gas station and service center are received by the hydraulic excavator in accordance with the processing shown in FIG. 6, and stored in the storage device 21 of the hydraulic excavator, at the same time as being displayed on the monitor 25.

In the above description, signals from the hydraulic excavators a1-cn are transmitted to the base station BC via a communications satellite CS, and signals are transmitted from the base station BC to the service center SF via a general public network PC. However, it is also possible to transmit signals for the hydraulic excavators using a mobile communication system such as a PHS telephone or portable phone, without using the communications satellite CS. It is also possible to use a dedicated line, the internet or a LAN connection. Also, the current location signal from the hydraulic excavator is transmitted to the service center SF, but it is also possible to transmit the current location signal to a management department of the hydraulic excavator owner to calculate various management information in the management department and transmitting this information to the hydraulic excavator.

It is also possible to have a hydraulic excavator manager as a rental merchant.

In the above description, the current location of the hydraulic excavator is transmitted to the service station SF via a communications satellite CS and a base station BC, but it is also possible to transmit signals from the communications satellite directly to the service station SF without going through the base station BC.

Figure 15:
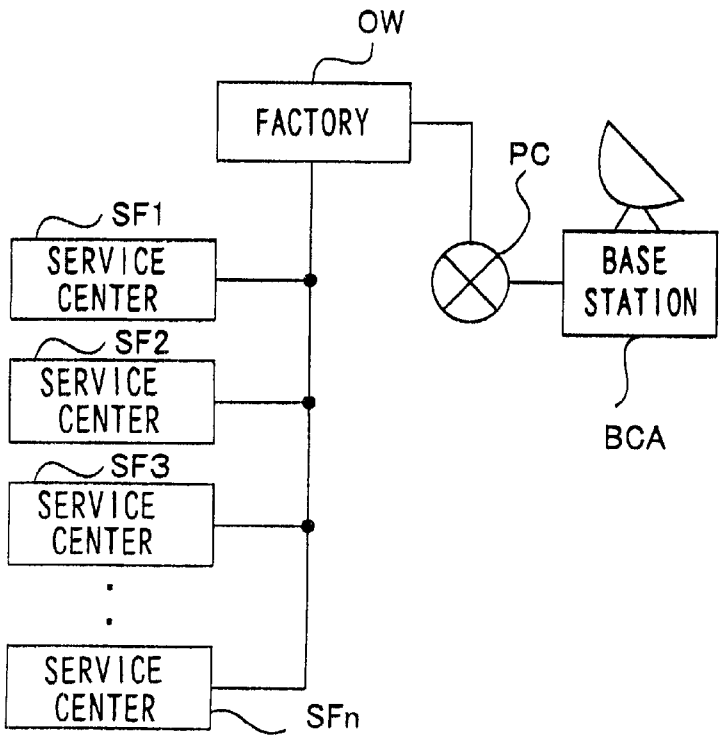
FIG. 15 is a drawing showing another example of connecting a wireless base station, a hydraulic excavator factory and a service center with a communications circuit.

Alternatively, as shown in FIG. 15, it is possible to connect a hydraulic excavator factory OW with a wireless base station BCA through a general public network PC, and to connect the hydraulic excavator factory OW to a plurality of service centers SF1–SFn using a dedicated circuit (intranet). In this case, as shown in FIG. 16, a system that is the same as the system inside the wireless base station BC Shown in FIG. 7 is provided in the hydraulic excavator factory OW.

Figure 16:
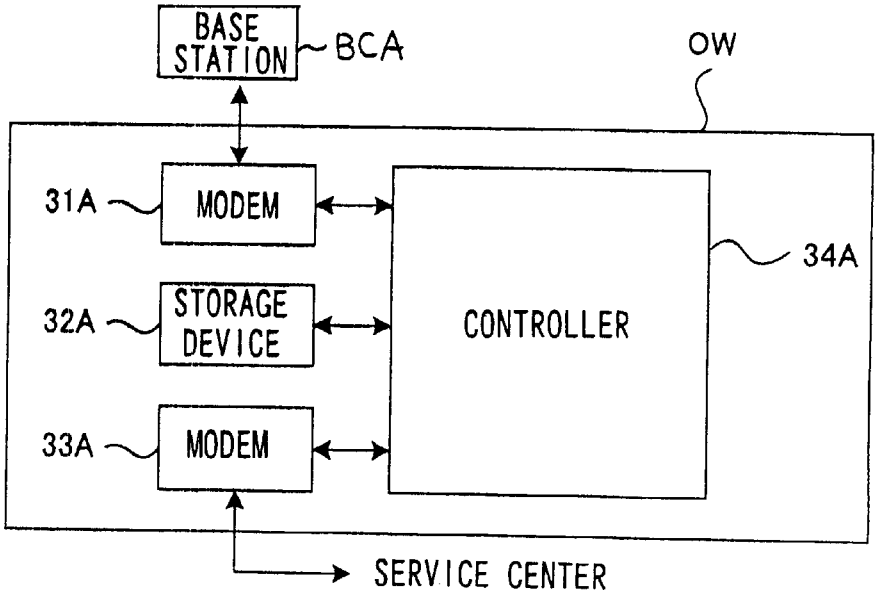
FIG. 16 is a drawing showing the system structure inside a hydraulic excavator factory.

In FIG. 16, at the factory OW, provided are a modem 31A for receiving signals transmitted from a communications satellite CS via the wireless base station BCA and a general public network PC, a modem 33A for transmission of data to be transmitted to the service station through a dedicated line, a storage device 32A for storing signals received by the modem 31A or the modem 33A, and a controller 34A for controlling these various devices. The same processing as in FIG. 8 is then executed by the controller 34A. It is also possible to provide the function of the hydraulic excavator factory OW in a head office facility of a company manufacturing the hydraulic excavator or in the above-described rental company.

It is also possible, for example, to transmit the various calculated items of information to a PDA having a communications function or a portable telephone carried by worker such as an operator or director working at the site.

The hydraulic excavator signals are transmitted via the modem 31A. Signals from the service center are received via the modem 33A.

Description has been given with hydraulic excavators as an example, but the present invention can also be widely applied to working machines including construction machines other than hydraulic excavators and other working vehicles.

What is claimed is:

1. A work management method for work sites, comprising the steps of:

detecting a position of a working machine;

transmitting a position signal for the detected position;

receiving the position signal;

calculating soil quality at the site of the working machine based on the received position signal;

calculating attachment information for the working machine based on the calculated soil quality; and transmitting the calculated attachment information to a working machine side receiver.

2. A work management method for work sites, comprising the steps of:

detecting a position of a working machine;

transmitting a position signal for the detected position;

receiving the position signal;

calculating telephone number of related facilities in the vicinity of the work site of the working machine based on the received position signal; and transmitting the calculated telephone number.

3. A work management method for work sites, comprising the steps of:

detecting a position of a working machine;

transmitting a position of a working machine;

transmitting a position signal for the detected position;

receiving the position signal;

calculating weather forecasts at the site of the working machine based on the received position signal; and updating a work schedule chart for the working machine that has been created in advance, based on the calculated weather forecast information.

4. A work management system for work sites, comprising:

a position detector that detects the position of a working machine;

a working machine side transmitter that transmits a position signal for the position detected by the position detector;

a working machine monitoring side receiver that receives the position signal of the working machine transmitted from the working machine side transmitter;

a soil quality calculator that calculates soil quality at the site of the working machine based on the position signal received by the working machine monitoring side receiver;

an attachment information calculator that calculates attachment information for the working machine based on the soil quality calculated by the soil quality calculator;

a working machine monitoring side transmitter that transmits the attachment information calculated by the attachment information calculator to a working machine side receiver; and the working machine side receiver that receives the attachment information transmitted from the working machine monitoring side transmitter.

5. A work management system for work sites, comprising:

a position detector that detects the position of a working machine;

a working machine side transmitter that transmits a position signal for the position detected by the position detector;

a working machine monitoring side receiver that receives the position signal of the working machine transmitted from the working machine side transmitter;

a calculator that calculates telephone number of related facsimiles in the vicinity of the site of the working machine based on the position signal received by the working machine monitoring side receiver;

a working machine monitoring side transmitter that transmits the calculated telephone number to a working machine side receiver; and the working machine side receiver that receives the telephone number transmitted from the working machine monitoring side transmitter.

6. A work management system for work sites, comprising:

a position detector that detects the position of a working machine;

a working machine side transmitter that transmits a position signal for the position detected by the position detector;

a working machine monitoring side receiver that receives the position signal of the working machine transmitted from the working machine side transmitter;

a calculator that calculates weather forecast information for the site of the working machine based on the position signal received by the working machine monitoring side receiver;

an updater that updates a work schedule chart for the working machine created in advance, based on the calculated weather forecast information; and a working machine side receiver that receives the updated work schedule chart transmitted from the working machine monitoring side transmitter.

7. A management information device for work sites, comprising:

a soil quality calculator that calculates soil quality at the site of the working machine based on a transmitted position of a working machine;

an attachment information calculator that calculates attachment information for the working machine based on the soil quality calculated by the soil quality calculator; and a transmitter that transmits the attachment information calculated by the attachment information calculator to the working machine side receiver.

8. A management information system for work sites, having a management information device comprising:

a soil quality calculator that calculates soil quality at the site of the working machine based on a transmitted position of a working machine;

an attachment information calculator that calculates attachment information for the working machine based on the soil quality calculated by the soil quality calculator; and a transmitter that transmits the attachment information calculated by the attachment information calculator to a working machine side receiver.

9. A management information device for work sites, comprising:

a calculator that calculates a telephone number of related facilities in the vicinity of a site of a working machine, based on a transmitted position of the working machine; and a transmitter that transmits the calculated telephone number to a working machine side receiver.

10. A management information system for work sites, having a management information device comprising:

a calculator that calculates telephone number of related facilities in the vicinity of a site of a working machine, based on a transmitted position of the working machine; and a transmitter that transmits the calculated telephone number to a working machine side receiver.

11. A management information device for work sites, comprising:

a calculator that calculates weather forecasts at the site of a working machine based on a transmitted position of the working machine; and an updater that updates a work schedule chart for the working machine created in advance, based on the calculated weather forecast information.

12. A management information system for work sites, having a management information device comprising:

a calculator that calculates weather forecasts at the site of a working machine based on a transmitted position of the working machine; and an updater that updates a work schedule chart for the working machine created in advance, based on the calculated weather forecast information.

13. A work management method for work sites according to claim 1, wherein:

the attachment information for the working machine is information such as a type of bucket claw, a type of bucket shape, or a type of excavating bit.

14. A work management system for work sites according to claim 4, wherein:

the attachment information for the working machine is information such as a type of bucket claw, a type of bucket shape, or a type of excavating bit.

15. A management information device for work sites according to claim 7, wherein:

the attachment information for the working machine is information such as a type of bucket claw, a type of bucket shape, or a type of excavating bit.

16. A management information system for work sites according to claim 8, wherein:

the attachment information for the working machine is information such as a type of bucket claw, a type of bucket shape, or a type of excavating bit.

* * * * *